US005797360A

United States Patent [19]

Pischinger et al.

[11] Patent Number: 5,797,360

[45] Date of Patent: Aug. 25, 1998

[54] METHOD FOR CONTROLLING CYLINDER VALVE DRIVES IN A PISTON-TYPE INTERNAL COMBUSTION ENGINE

[75] Inventors: Franz Pischinger, Aachen; Matthias Schneider, Aldenhoven; Guenter Schmitz, Aachen; Martin Pischinger, Aachen; Thomas Esch, Aachen, all of Germany

[73] Assignee: FEV Motorentechnik GmbH & Co KG, Aachen, Germany

[21] Appl. No.: 874,224

[22] Filed: Jun. 13, 1997

[30] Foreign Application Priority Data

Jun. 14, 1996 [DE] Germany ..... 196 23 698.3

[51] Int. Cl.[6] ..... F01L 9/04

[52] U.S. Cl. ..... 123/90.11; 123/90.15

[58] Field of Search ..... 123/90.11, 90.12, 123/90.13, 90.15; 73/117.3, 119; 251/129.01, 129.02, 129.05, 129.1, 129.16

[56] References Cited

U.S. PATENT DOCUMENTS

| | | | |
|---|---|---|---|
| 4,957,074 | 9/1990 | Weissler, II et al. | 123/90.11 |
| 5,140,955 | 8/1992 | Sono et al. | 123/90.11 |
| 5,190,013 | 3/1993 | Dozier | 123/90.11 |
| 5,611,303 | 3/1997 | Izuo | 123/90.11 |
| 5,636,601 | 6/1997 | Moriya et al. | 123/90.11 |

*Primary Examiner*—Weilun Lo
*Attorney, Agent, or Firm*—Spencer & Frank

[57] ABSTRACT

A method for a controlling cylinder valve drive in a piston-type internal combustion engine includes the steps of detecting vibration signals generated during operation by the cylinder valve drive or the cylinder valve, and actuating the cylinder valve drive in dependence on a value of the detected vibration signals which corresponds to the impact time or impact speed of the cylinder valves.

13 Claims, 6 Drawing Sheets

FIG. 5.1
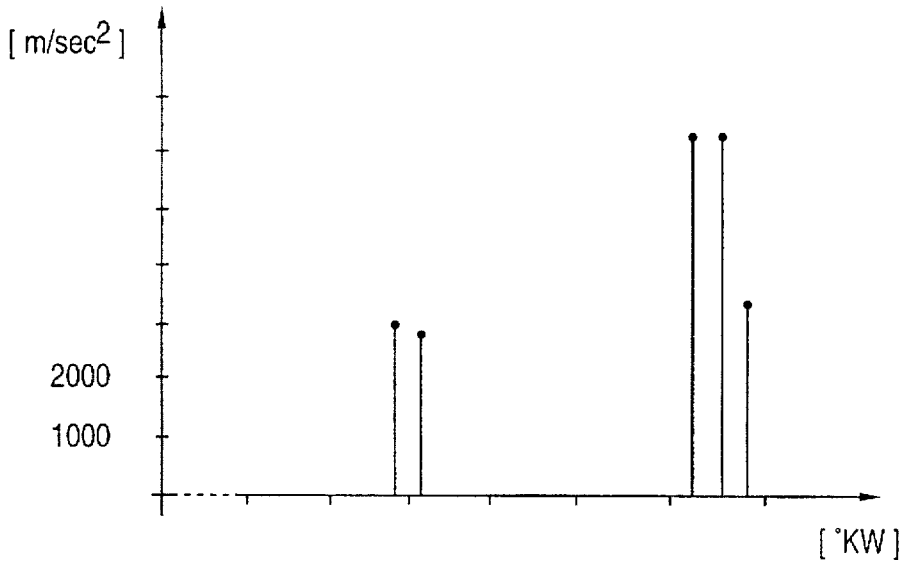
FIG. 5.2
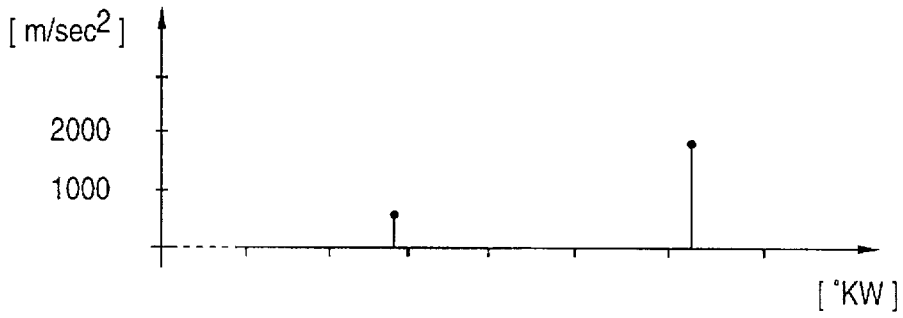
FIG. 5.3
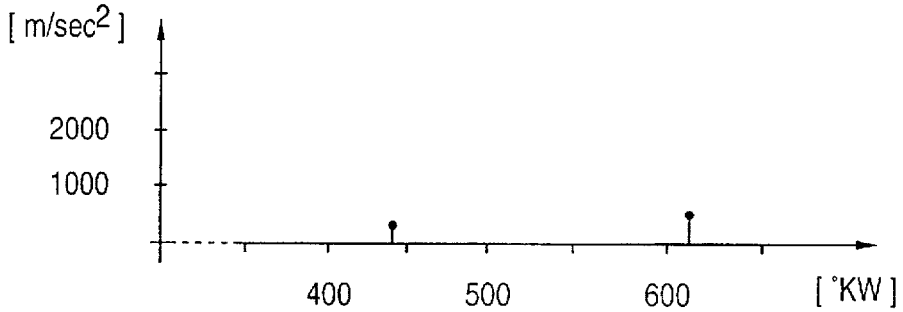

METHOD FOR CONTROLLING CYLINDER VALVE DRIVES IN A PISTON-TYPE INTERNAL COMBUSTION ENGINE

CROSS-REFERENCE TO RELATED APPLICATIONS

This application claims the right of priority with respect to German Application No. 196 23 698.3 filed in Germany on Jun. 14, 1996, the disclosure of which is incorporated herein by reference.

BACKGROUND OF THE INVENTION

Circuit arrangements with separate magnetic armatures are used for the actuation of cylinder valves in a piston-type internal combustion engine. These armatures are connected to the cylinder valve to be actuated, are held in their resting position between two electromagnets by restoring springs and are induced to make contact with one or the other electromagnet, respectively, in that one or the other electromagnet is supplied alternately with current in accordance with preset actuation values, so that the cylinder valve connected with it is then held in its opened or its closed position. The movement of the cylinder valve from one position to the other is caused by turning off a holding current to the electromagnet holding the magnetic armature, so that the effect of the restoring spring force will move the armature in the direction of the opposite, capturing electromagnet. Once the armature has passed a center position between the two electromagnets, the movement of the armature is slowed down by an increase in the spring force of the restoring spring associated with the capturing electromagnet. In order to capture the armature in the new position and hold it there, the capturing electromagnet is supplied with current.

The problem with this capturing process is that the required coupling in of force via the electromagnets into the armature depends on numerous parameters. Thus, the slowing down of the cylinder valve through the gas forces varies widely based on the actual motor load, and this is particularly true for the exhaust valve. In addition, the coupling in of energy into the respective capturing electromagnets by the current supply, required for the capturing, is subject to being influenced by production tolerances and wear. However, the "correct" dosing of the supplied energy is important for a trouble-free operation of the internal combustion engine. If the energy coupled in is too high, this leads to extremely high wear in the circuit arrangement as well as along the sealing surfaces of valve and valve seat, and the noise level becomes intolerable. In extreme cases, there is also the danger of the armature rebounding off the capturing electromagnet, which leads to the danger of a valve operation failure during this operating cycle. On the other hand, if the energy coupled in is too low, then the armature is not captured correctly, causing the valve to swing back, meaning it does not open or close properly, depending on the operating cycle, so that an operational failure must be registered, at least during this operating cycle.

SUMMARY OF THE INVENTION

It is an object of the invention to provide a method for controlling cylinder valve drives on a piston-type internal combustion engine, which permits detection of the impact time and/or impact speed of a cylinder valve and to actuate the drive based on this.

The above and other objects are accomplished according to the invention by the provision of a method for controlling a cylinder valve drive arranged for driving a cylinder valve in a piston-type internal combustion engine, comprising: detecting a vibration signal generated during operation by at least one of the cylinder valve drive and the cylinder valve; and actuating the cylinder valve drive in dependence on a value of the detected vibration signals which corresponds to at least one of impact time and impact speed of the cylinder valve.

The vibration signals here are primarily constituted by impact sound signals. For valves with conventional valve drives, such signals are generated in each case when the valve disk impacts with a valve seat. The detection of the impact time for such conventional valve drives is of interest, in particular if the drives can be selectively adjusted with respect to the opening and closing time. The inventive method is particularly important for electromagnetic valve drives because corrections in the actuation can be made by way of detecting the impact time in accordance with the preset operating conditions for the piston-type internal combustion engine. One particularly important option is the use of the detection of the impact speed, meaning also the impact energy, for regulating the absorption of energy into the electromagnet, such that it results in a "soft" landing of the armature on the pole surfaces or of the valve on the valve seat.

For one preferred embodiment of the invention, it is provided that the sound generated by the cylinder valve is detected by a sound sensor as the vibration signal. It is particularly useful if the vibration signal is detected via the impact sound by an impact-sound sensor. However, it is also possible to detect the generated air sound via an air-sound sensor, for example a microphone.

Another embodiment of the invention provides that the dynamic effects generated by the cylinder valve are detected by a force sensor as vibration signal. Piezoelectric sensors can be used for this, for example, which can be designed as plain washers that are arranged at the fastening for the valve drive. Wire strain gauges can also be used as force sensors, since the introduction of force as a result of the valve or armature impact causes changes in length, for example at the electromagnetic valve drives, which can also be detected as introduction of force.

One embodiment of the invention provides that the vibration signals, preferably the impact sound generated by the individual cylinder valves, are detected with a central sensor. In particular, for the detection of the vibration signals via the impact sound, it is possible to detect the vibration signals emanating from the individual cylinder valves because of the transmission through a respective component, for example a cylinder head cover. Thereafter, the valve drive actuation may be triggered based on the detection of the vibration signals. In the case of electromagnetic valve drives, the drives for the individual cylinder valves may be triggered.

One suitably different embodiment of the invention provides that the developing vibration signal is respectively detected by a separate sensor assigned to each cylinder valve. This ensures that the respectively generated vibration signal on each cylinder valve can be detected directly, without delay and without any kind of adulteration, can be evaluated and can be used to control the associated valve drive. This is true for detecting the vibration signals via the impact sound as well as for the developing, periodic introduction of force for each cylinder valve.

For one embodiment of the inventive method, it is provided that the amplitude for the detected vibration signal is used as the measure for the impact speed. The respective point in time when a valve impacts with its valve seat, or in the case of electromagnetic valve drives, the point in time when the armature impacts with the pole surface of the respectively capturing electromagnet, can be detected precisely in each case, owing to the time-related detection of the vibration signal, so that through corresponding corrections of the valve drive actuation, in particular for electromagnetic valves, the desired point in time for the respective valve event (opening and/or closing) can be adapted through a corresponding change in the actuation.

The amplitude for the respectively detected vibration signal is proportional to its impact speed, meaning the kinetic energy absorbed when the valve or armature impacts with the respective counter surface can be detected either as an introduction of force, or as sound, depending on the measuring method used. Corresponding changes in the current supply to the electromagnet therefore make it possible to reduce the energy to be coupled in by the current, such that a predetermined, low signal amplitude is not exceeded.

For another advantageous embodiment of the inventive method, it is provided that the vibration signals for the valve drive actuation must be detected respectively within a preset time and/or frequency window. This embodiment has the advantage that interference signals can be filtered out, such as can be caused, in particular, by knocking in the piston-type internal combustion engine. The arrangement of a so-called time window is important, particularly with respect to distinguishing between vibration signals, caused by knocking and vibration signals, caused by the impact of the cylinder valves. Such knocking occurs only within certain crank angle ranges. The time window makes it possible to screen vibration signals caused by knocking from vibration signals emanating from the cylinder valves, so that a clear correspondence is possible in this case. The term "time window" relates to a certain time range, which can vary, however, depending on the engine speed (rpm). Thus, time window actually refers to a fixed time interval as well as a crank angle interval, for which the actual time length varies with the engine speed.

It is, however, particularly useful if the impact detection of the inventive method is combined with a detection of the knocking sounds. A method for detecting the knocking intensity is basically known. Combining the two evaluation operations, meaning the evaluation of the knocking intensity and the evaluation of the impact detection, provides a particularly easy method of keeping the two events reliably apart. This is of importance, particularly if the piston-type internal combustion engines are equipped with electromagnetic valve drives. Such electromagnetic valve drives are fully variable, independent of the crank angle, and can be actuated at practically any point in time via a corresponding electronic engine control. By combining the knocking evaluation and the evaluation of the impact detection, in connection with the actuation of the valve drives, the mutual influences of the knocking adjustment on the impact detection and vice versa can be omitted by presetting a window for the point in time of the expected valve impact. One useful value for the time window is about 1 ms. In particular when detecting the basic motor noise, it is useful to provide a so-called frequency window, advisably in combination with a time window, which covers the frequency range between 5 and 20 kHz. The use of amplification or reduction factors based on the operating point (especially the engine speed, load or temperature) can also be useful, particularly for a stronger basic motor noise. While it is generally possible to use the same sensor for detecting the knocking intensity and also for determining the impact, it is advisable to use different sensors for the knocking detection and the impact detection. Together with the location selected for mounting the respective knocking sensor, this allows the sensor, for example, to record the lowest possible number of signals from the valve movement and vice versa.

One embodiment of the inventive method provides that in addition to the impact detection, the existing basic motor noises are detected and are taken into consideration when determining the magnitude of the vibration signals. In this case, either the detected basic noise can be subtracted from the determined energy value for the impact signal, or the quotient of the two values can be determined. All methods described in the literature for determining a knocking intensity are suitable for this.

BRIEF DESCRIPTION OF THE DRAWINGS

The invention is explained in more detail with the aid of the following drawings.

FIGS. 5.1, 5.2 and 5.3 are signal recordings for varied impact speeds of a cylinder valve.

DETAILED DESCRIPTION OF THE INVENTION

Figure 1:
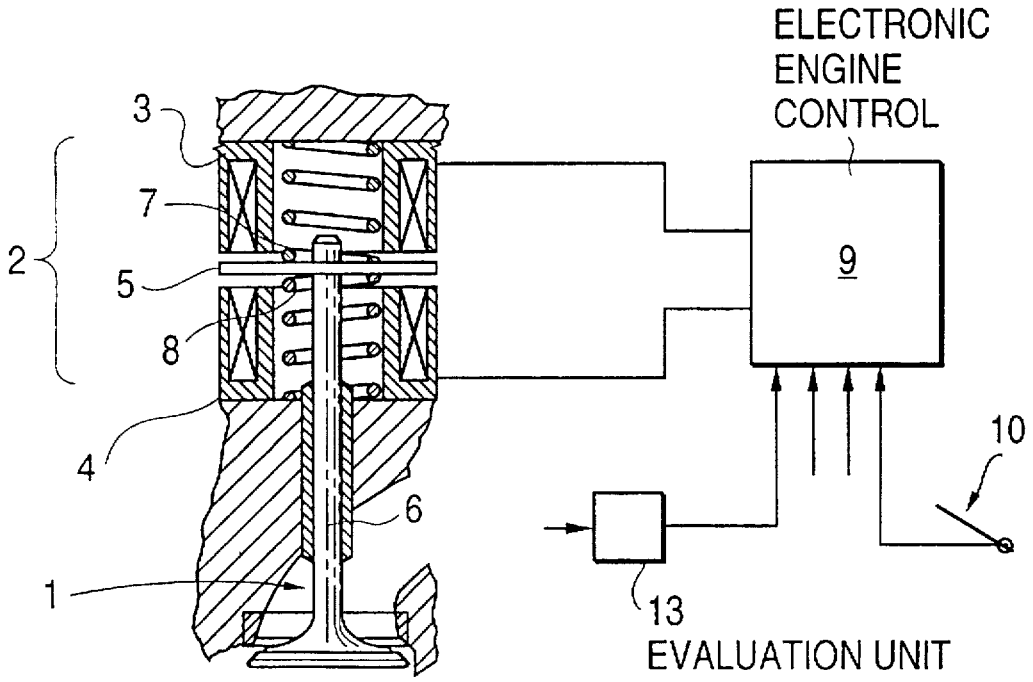
FIG. 1 is a cylinder valve with electromagnetic valve drive.

FIG. 1 shows a cylinder valve 1 for a piston-type internal combustion engine, which is provided with an electromagnetic valve drive 2. Electromagnetic valve drive 2 has two electromagnets 3 and 4, arranged at a distance from each other. An armature 5 is connected to a shaft 6 of valve 1 and is positioned for movement back and forth between the two electromagnets. If the electromagnets are not supplied with power, armature 5 is held in a center position between electromagnets 3 and 4 by a restoring spring 7 that is coordinated with electromagnet 3 and a restoring spring 8 that is coordinated with electromagnet 4. If power is supplied to electromagnet 3, armature 5 is attracted and makes contact with the pole surface of electromagnet 3, so that cylinder valve 1 is held in a closed position. If electromagnet 3 does not receive power and electromagnet 4 is supplied with power, armature 5 moves, initially accelerated by the force of restoring spring 7, in the direction of electromagnet 4 and is captured by this electromagnet, so that armature 5 comes to rest against the pole surface of electromagnet 4 and keeps cylinder valve 1 in an opened position.

Depending on its arrangement on the respective piston-type internal combustion engine, the cylinder valve functions as an intake valve or an exhaust valve, wherein at least one intake valve and one exhaust valve exist for each cylinder. With electromagnetic valve drives, the actuation of the individual intake valves and exhaust valves on a piston-type internal combustion engine occurs via an electronic engine control 9 as shown in FIG. 1. In addition to a presetting of the desired load via a gas pedal 10, the basic preset values for the engine speed, the crank angle, the motor temperature and other relevant or desired data for a trouble-free motor operation are predetermined for motor control 9 and are processed in electronic engine control 9, which then generates the respective adjustment signals for supplying power alternately to the electromagnets of the individual valve drives for the cylinder valves.

Figure 2A:
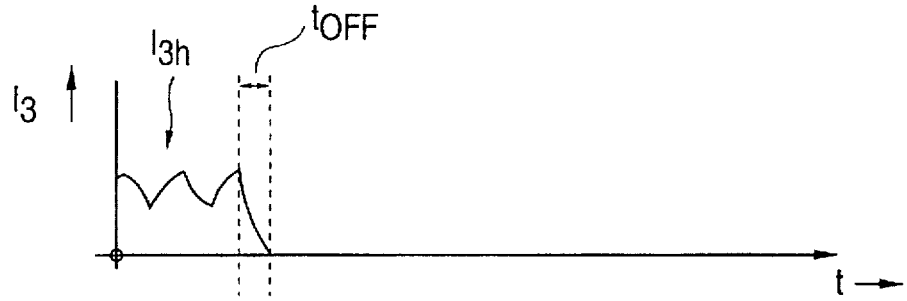
FIGS. 2*a*–2*c* are diagrams illustrating coil current paths and valve position in dependence on time.
Figure 2B:
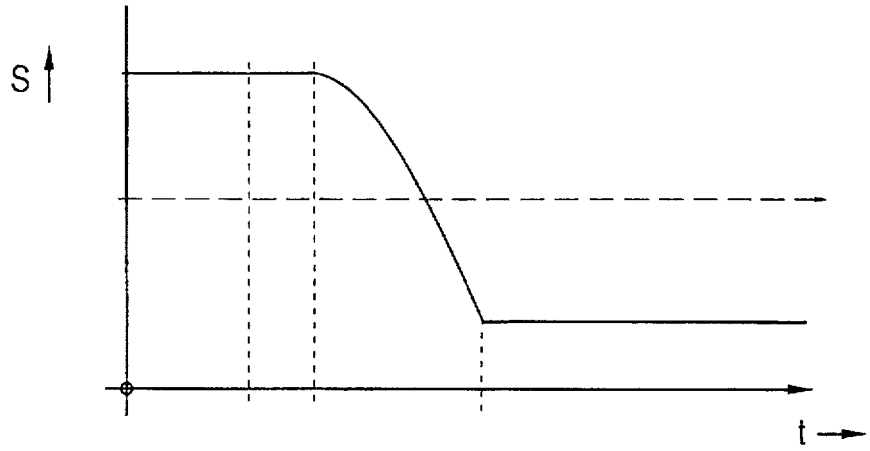
Figure 2C:
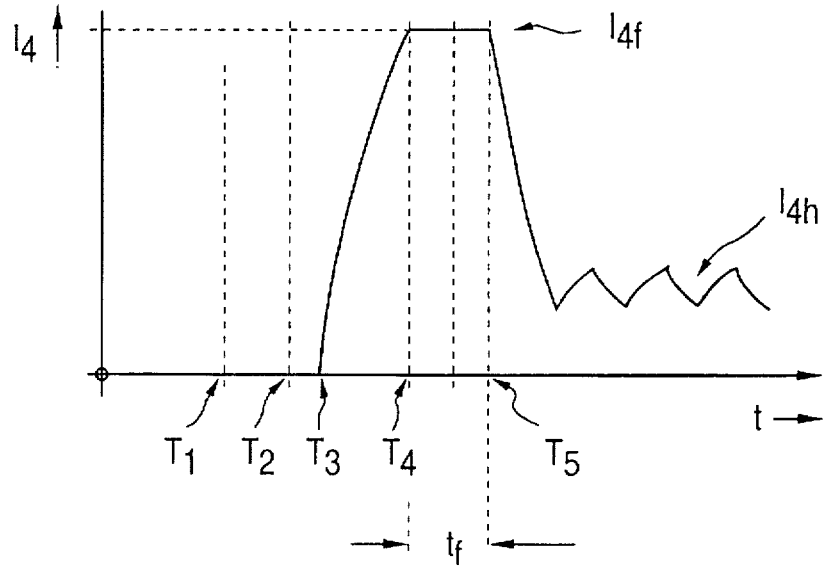

The time-related course of the current flow in electromagnets 3 and 4 (FIG. 1) is shown in FIGS. 2*a* and 2*c*, respectively, and the curve for the position relative to time for armature 5 is shown in more detail in FIG. 2*b*.

If cylinder valve 1 must be opened, then the supply of power to electromagnet 3 is cut at point in time $T_1$. The holding current drops over a time period $t_{off}$, wherein armature 5 still rests against electromagnet 3 even after the power has dropped, during the so-called adhesion time. Armature 5 does not start to move under the influence of the dynamic force of restoring spring 7 until the point in time $T_2$, as can be seen from the position curve in FIG. 2*b*. As soon as armature 5 has passed the center position (indicated by horizontal dashed line in FIG. 2*b*) given by the dynamic effect of the two restoring springs 7 and 8, the increasing restoring force of restoring spring 8 acts counter to the armature movement. In order to "capture" armature 5 at electromagnet 4 and to hold cylinder valve 1 securely in the open position, power is supplied at point in time $T_3$ to electromagnet 4, so that the maximum capturing current 4*f* is reached at point in time $T_4$ even before armature 5 impacts with the pole surface of electromagnet 4. This maximum capturing current is maintained over a preset time interval $t_f$ until a point in time $T_5$, wherein the interval $t_f$ is calculated such that it ensures a secure impacting of armature 5 with the pole surface of electromagnet 4. At point in time $T_5$, the current at electromagnet 4 is then reduced to a level of a holding current $I_{4h}$, wherein holding current $I_{4h}$ is again clocked during the holding period in order to reduce the current consumption. For the closing of the valve, the holding current $I_{4h}$ is turned off correspondingly via electronic engine control 9, so that the above described time-related course of the current supply and the valve movement occurs in an opposite direction.

This shows that the speed at which armature 5 impacts with the pole surface of the respectively capturing electromagnet depends on the level of the capturing current. If the capturing current level preset by the control is too low, then the restoring spring force that is effective in the opposite direction is too high, so that the armature does not even make contact with the pole surface of the electromagnet under current. If the capturing current level is selected too high, then the armature experiences a corresponding acceleration in the final phase of its approach to the pole surface, so that the armature impacts with the pole surface at a high speed, such that in this case the energy of the movement is correspondingly converted into a force acting upon the pole surface, thereby resulting in the development of sound. In this case as well, there is the danger with very high current levels that the armature rebounds completely owing to the elastic material conditions and is not captured at all or, if the capturing current levels are lower, performs one or several rebounding movements, between which it is always captured, until it finally comes to rest against the pole surface of the capturing electromagnet. This also results in disadvantages for the engine operation. The point in time for the start-up ($T_3$ according to FIG. 2*c*) can also be used to influence the energy absorption in place of the current level or in addition to the current level.

The impact speed can also be influenced by factors other than the current level, for example by production-related or wear-related mechanical tolerances in the system, the effects of changing temperatures caused by the operation and similar external influences. These influences can be corrected or compensated for via a corresponding adjustment of the capturing current level when actuating the electromagnetic valve drive, as follows from the above description relating to FIGS. 2*a* to 2*c*.

Since it is vitally important for engine operation that the individual cylinder valve to be actuated is closed or opened at an exact preset point in time in accordance with the operating cycle, the use of electromagnetic valve drives in particular, for which armature 5 comes to rest against the pole surface of the respective capturing magnet in the opened position as well as the closed position, offers the possibility of an exact determination of the time. The electromagnetic valve drive option of a free and variable actuation of the cylinder valves according to the requirements and by taking into consideration the optimum operating conditions can be used advantageously with the aid of the electronic engine control. Since the conversion of the armature kinetic energy into force and/or sound when the armature impacts with the pole surface always generates a corresponding vibration signal, the possibility is offered for detecting and evaluating this vibration signal for the purpose of control and/or adjustment.

Figure 3:
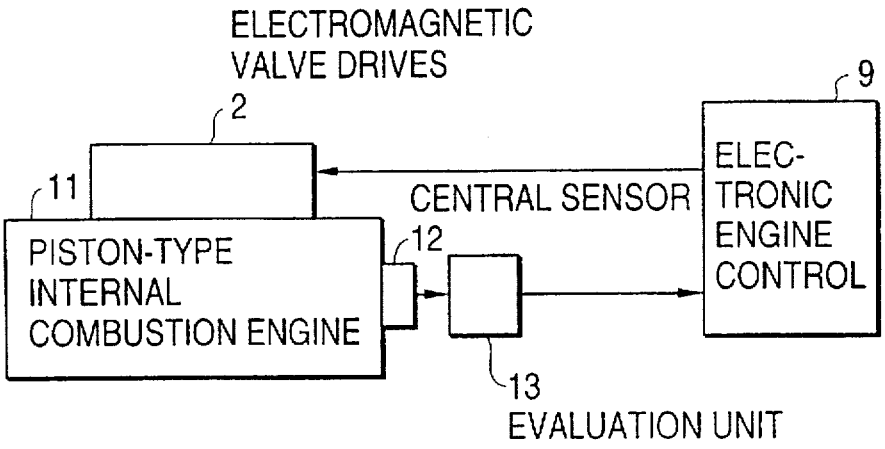
FIG. 3 is a block circuit diagram of a basic layout of a control according to the invention.

A block circuit diagram for the basic layout according to the invention is shown in FIG. 3. A piston-type internal combustion engine 11 has a corresponding number of cylinder valves, which are each provided with electromagnetic valve drives 2 (here shown as a unit). A central sensor 12 is here assigned to engine 11, or a separate sensor 12 is assigned to each cylinder valve for detecting the vibration signal which is generated as a result of an impact between an armature and the respective pole surface. The vibration signal detected via sensor 12 is then compared in an evaluation unit 13, for example with respect to its amplitude, with a predetermined specified value. If the actual value is higher than the specified value, meaning the speed at which the armature impacts with the pole surface of the capturing electromagnet is too high, then the respective electromagnet is supplied with a reduced capturing current during the following actuation by way of a corresponding correction signal via electronic engine control 9, so that the armature subsequently impacts with a lower impact speed.

Figure 4:
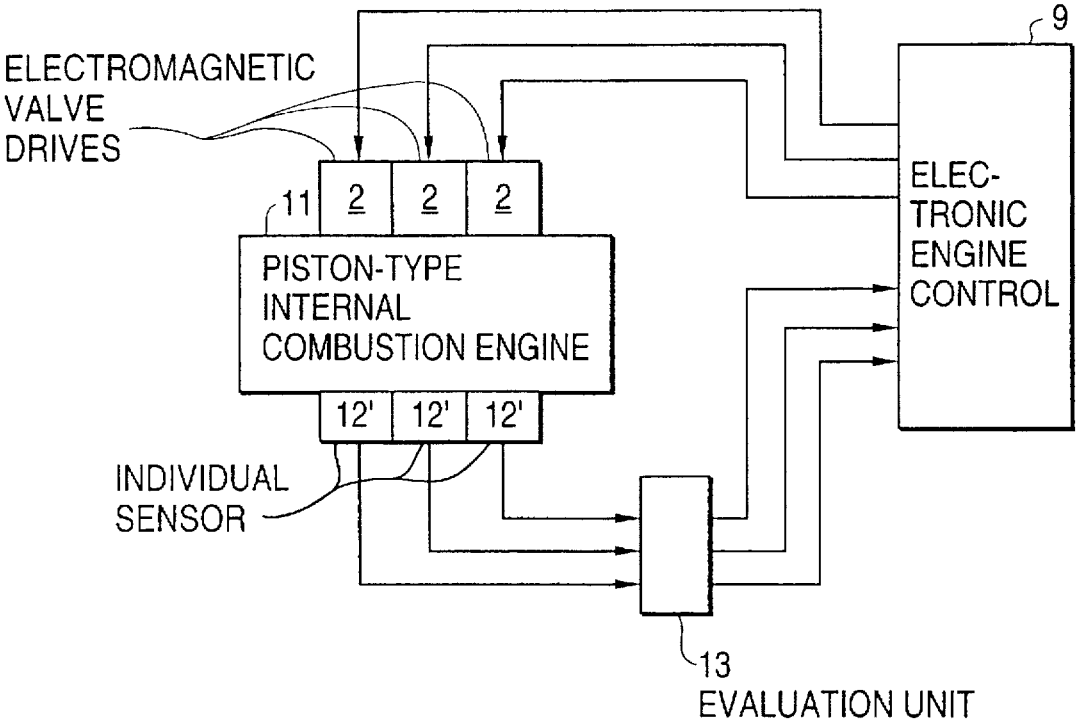
FIG. 4 is a block circuit diagram of a modification of the control according to FIG. 3.

As is evident in FIG. 4, it is possible to assign a separate sensor 12' to each individual electromagnetic valve drive 2, so that the electromagnetic valve drive for each cylinder valve can be actuated individually, and so that production tolerances, different wear conditions, etc., can be compensated.

The vibration signal can here be detected via an impact sound sensor. However, it is also possible to detect and process accordingly the impact time as well as the impact speed or the impact energy derived from the impact speed with corresponding force sensors or even deformation sensors, which can be arranged, for example, in the connecting screws between the two electromagnets 3 and 4.

FIG. 5 shows three different measurements of the impact sound detected for different impact speeds of a cylinder valve. The recorded measurements show the vibration signals developing during the opening of a valve (here at a 440° crank angle) and those developing during a valve closing (here at a crank angle of about 670° ). The recorded measurement 5.1 shows the developing vibration signals for high impact speeds, the recorded measurement 5.2 the vibration signals for average impact speeds and the recorded measurement 5.3 shows the vibration signals for low impact speeds, for which a "soft" impact occurs.

This clearly shows that when a cylinder valve is opened, only the impact of the armature with the pole surface of the capturing electromagnet 4 causes an energy conversion that depends on the level of the impact speed. In contrast, the conversion of energy during the closing of the cylinder valve occurs as a result of the impact of the armature 5 with the pole-surface of the capturing electromagnet 3 as well as when the valve disk for the cylinder valve 1 impacts with the valve seat.

When comparing the diagrammatic sections of the recorded measurements, it is obvious that rebounding effects occur with a high impact speed according to FIG. 5.1, whereupon it is also obvious that in the end, the armature plate still comes to rest against the capturing electromagnet. A reduction in the impact speed results in a clear reduction in the vibration signal, as can be seen in FIGS. 5.2 and 5.3. On the other hand, a comparison of these recorded measurements shows clearly that with a corresponding configuration of the sensor sensitivity and a corresponding filtering out of the interference vibrations via the vibration signal detection and a corresponding signal evaluation, it is possible to influence the level of the capturing current with the aid of electronic engine control 9. The recorded measurements show that a time signal referred to the crank angle is available at the same time via the detection of the vibration signal, so that changes in the start of the opening and closing, as well as the opening time can be controlled and adjusted.

It is obvious from FIG. 2 that a minimum movement time for the armature is preset, based on such mechanical parameters as the spring constant, weight and frictional forces, which can still be influenced slightly by varying the coupling in of force via the capturing electromagnet 4. In order to omit interfering influences, for example through knocking, it is advisable if the time window for the impact sound evaluation is "opened" only upon completion of this minimum movement time. The point in time $T_5$ for switching back the holding current is generally configured with the aid of the engine control 9, such that the armature 5 has already arrived safely. As a result of this, the control edge of this control signal can be used for "closing" the time window as explained below with reference to FIG. 6.

Figure 6:
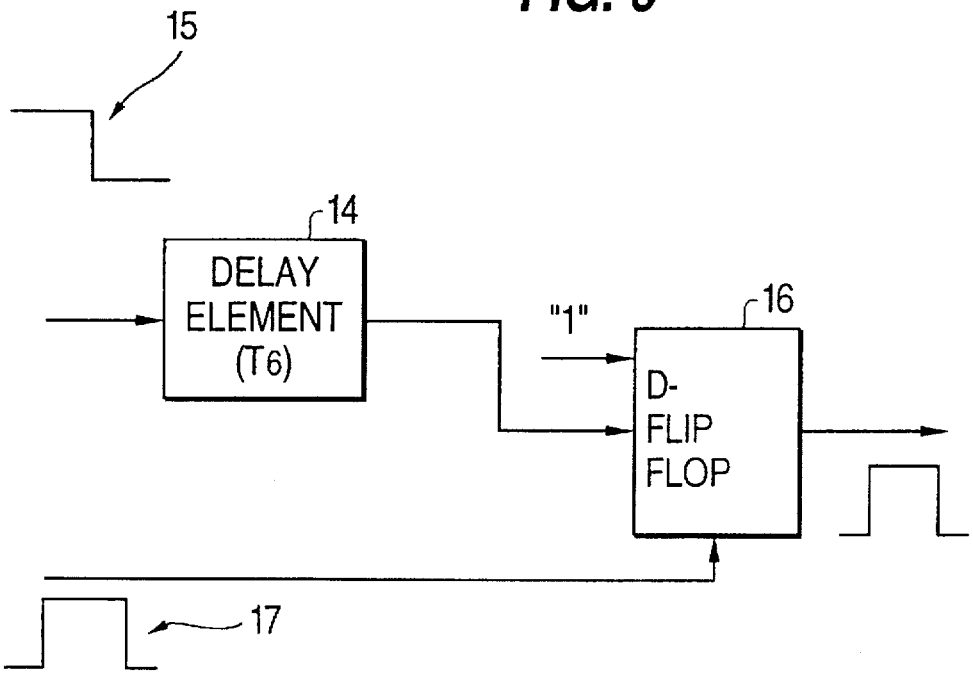
FIG. 6 is a block circuit diagram of an arrangement for forming a time window according to another aspect of the invention.

Referring to FIG. 6 there is shown a corresponding circuit diagram which comprises, for example, a delay element 14 that is triggered with a rear edge 15 of the holding signal for closing electromagnet 3. Following a time delay $T_6$, which can also be preset by the engine control depending on the operating point, an output for delay element 14 switches to a logic "1," thus causing a D-flip-flop 16 to be set to "1." As soon as a holding signal 17 on the side of capturing electro-magnet 4 moves to "1," D-flip-flop 16 is reset to "0." Thus, the output for D-flip-flop 16 forms exactly the previously described time window.

Other signals can also be used to control this circuit. Thus, the signal from a so-called separation detector that detects the start of the armature movement following a shutting down of the holding current can also be transmitted to the input of delay element 14. Alternatively, an impact detection signal can be transmitted to the reset input of delay element 14, wherein this signal can also be obtained by evaluating the impact sound signal. The actual value of an integrator can be used for this, if necessary following subtraction of a basic noise, which represents a measure for the impact sound energy detected so far. This value is compared with a threshold possibly fixed in dependence on an operating point. The digital signal "1" is generated if this threshold is exceeded.

Alternatively, the evaluation of the current curve or even the associated voltage curve at the capturing electromagnet can also be used to determine the window, in particular the start of the window. This makes use of the effect that a counter-voltage is generated as a result of the approach of armature 5 to the pole surface of the capturing electromagnet, which can be measured directly in the case of an adjustment of the capturing current, or which can, in other cases, be discerned by a less steep rise in the current curve or even a drop in the current. In this case, the signal for the start of the window can also be obtained through a detection of the threshold value for the voltage or current or the differentiated signals formed from this. Also, the start of the window can be set in each case by an additional position sensor, which determines the armature position or the valve position. In all cases, it is not strictly necessary to design the circuit such that it determines the optimum start for the window. Rather, the output signal from the evaluation circuit can become active at an earlier point in time, while the window can then be opened with a time delay at an optimum point in time.

Figure 7:
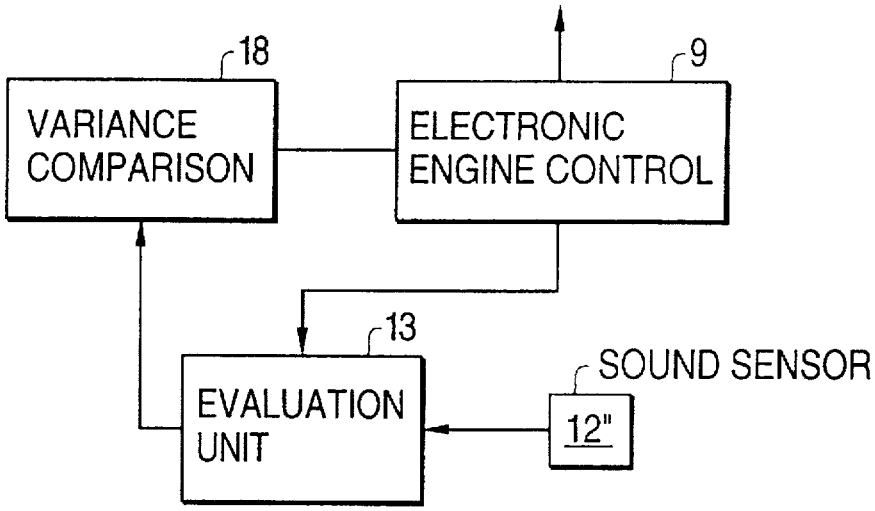
FIG. 7 is a block circuit diagram for a circuit used to adjust the impact time of a cylinder valve.

The block diagram according to FIG. 7 shows an adjustment of the valve movement by making use of the detection of the point in time for the impact. As shown in FIGS. 1 and 3, the values are again preset via the electronic engine control 9. The point in time when the armature impacts with the pole surface of the respective capturing magnet is detected by an evaluation unit 13 via a sound sensor 12". The detected value is corrected via a desired value/actual value comparison 18, so that the respective valve can be actuated with the corrected value via the electronic engine control 9. Production tolerances, the effects of wear, temperature, gas counter-pressure and other influences can be compensated for with this.

An adjustment of the impact speed can also be made in the same way via the detection of the impact speed. As a result of this, the impact speed can be optimized such that on the one hand, a secure operation is ensured, and on the other hand, the noise and also the energy expenditure for operating the valve drive becomes minimal. Production tolerances, the effects of wear, temperature or other influences can also be compensated through detecting the impact speed and an adjustment of the impact speed derived from this.

Figure 8:
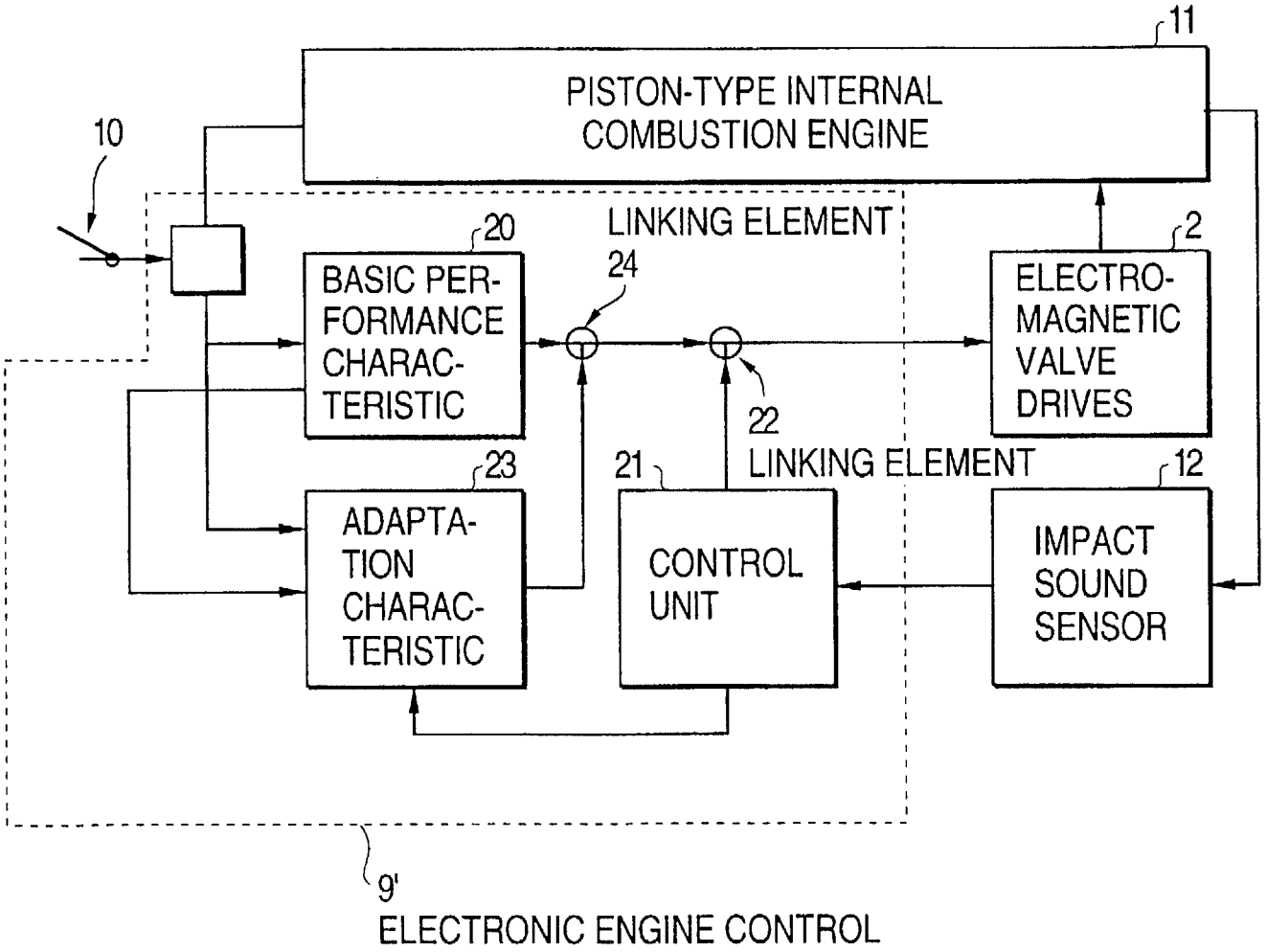
FIG. 8 is a block circuit diagram for a compensation circuit designed to take into account varied outside influences on valve actuation.

A preferred embodiment of the compensation method is shown in FIG. 8, again in the form of a block circuit diagram. Engine 11 is controlled via a basic performance characteristic in the electronic engine control 9', which comprises all control information gained from the performance characteristics, such as the required capturing energy, the current level, the switching-on time or the voltage level that are transmitted to an electromagnetic valve drive 2 and which then actuate the associated engine valve accordingly. The switching energies resulting from the valve movement are measured, for example, via the impact sound sensor 12" and are fed to a control unit 21. This unit can make changes directly to the control parameters in that these are modified correspondingly in a linking element 22 with preset values from the control unit 21. This modification can consist of an addition of the signals arriving from the basic performance characteristic 20 or of a multiplication or other linking, as shown in FIG. 8. As soon as the control unit has found the correct values that apply to the characteristic range presently driven, control unit 21 stores the correspondingly necessary modifications in an additional adaptation characteristic 23, which ensures that during the following start-up of this characteristic range, the correct values are automatically realized. The respective modification of the values from the basic performance characteristic 20 occurs via an additional link 24, which can also be an addition or multiplication, such as link 22 with the signal from the control unit 21.

The input information for the basic performance characteristic 20 and the adaptation characteristic 23 can be either signals generated directly at the engine, e.g. the engine speed or temperature for the engine and/or they can also be external signals, e.g. the load specified by the accelerator 10. The signals involved do not have to be identical for the basic performance characteristic 20 and the adaptation characteristic 23. Rather, certain signals can be omitted from the adaptation characteristic 23. In particular, it is sufficient to have a less precise partitioning of the adaptation characteristic as compared to the basic performance characteristic 20 and thus also a smaller number of support locations.

A clear differentiation of the impact signals for the different valves and also of the resulting possible interferences through knocking detection algorithms can be made with cyclical variations of the valve control values. Thus, all valves can successively be moved directly to the ideal operating range.

This method is described in more detail below. Initially, it is determined on the engine control side which events (impacting of valve and/or the armature) occur within the same or overlapping windows. Subsequently, one of the events is purposely amplified in that the impact speed of a valve and/or an armature is increased through increasing the capturing energy (increasing the capturing current) or the knocking is intensified by resetting the ignition to an earlier point in time. However, since the knocking is a stochastic [random] process, it is preferable if an attempt is first made to prevent the effect of the engine knocking through a secure adjustment.

Following this, a case differentiation is made.

a) If the energy in the observed window does not increase or only insignificantly increases, it must be assumed that another event is already dominant. That is the reason why the test adjustment of the initially selected event is reversed to "amplify" another event instead. Following this adjustment, the case differentiation must be made again.

b) If the measured impact sound energy increases within the observed window, a dominance of the selected event must be assumed. If necessary, the energy is increased by another step, until the dominance is clear. Following that, it is determined how high the excess energy is compared to the normal operation, for example through a comparison with specified values or previously stored experience values, and the value for the actual capturing energy or the corresponding current supply parameters (for example current level or switching-on time for the current, or voltage level) can be adjusted correctly.

All events occurring during the respective window are dealt with in this way. If it was possible to reduce (clearly) the total energy of the impact sound in the window, then the procedure can be performed again if necessary to obtain even more favorable adjustments.

Experience values can be used to determine the event selected for the first variation. These experience values can refer to how sensitive a certain event reacts to an increase or a reduction in the energy supply, so that, for example, a valve that fails easily is varied first. Failing in this case means, for example, that the valve is not captured properly as a result of capturing energies that are too low. Also, the initial adjustment for the capturing energy or for the first valve event to be varied can be made to depend on the temperature or similar operating parameters.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A method for controlling a cylinder valve drive operatively arranged for driving a cylinder valve of a cylinder in a piston-type internal combustion engine, comprising:

detecting vibration signals generated during operation by at least one of the cylinder valve drive and the cylinder valve; and actuating the cylinder valve drive in dependence on a value of the detected vibration signals which corresponds to at least one of impact time and impact speed of the cylinder valve.

2. The method according to claim 1, wherein the step of detecting vibration signals includes using a sound sensor for detecting an impact sound generated by the cylinder valve.

3. The method according to claim 1, wherein the step of detecting vibration signals includes using one of a force sensor and a deformation sensor for detecting a force introduced upon impact by at least one of the cylinder valve drive and the cylinder valve.

4. The method according to claim 3, wherein the engine includes a plurality of cylinder valves and a plurality of cylinder valve drives each operatively arranged for driving a respective one of the cylinder valves, and the using step includes using a central sensor for detecting vibration signals for the force introduced by the plurality of cylinder valves.

5. The method according to claim 3, wherein the engine includes a plurality of cylinder valves and a plurality of cylinder valve drives each operatively arranged for driving a respective one of the cylinder valves, and the using step includes using a plurality of sensors each associated with a respective one of the cylinder valves for detecting energy introduced by the impact of the respective cylinder valves.

6. The method according to claim 5, including measuring the impact speed based upon an energy of the detected vibration signals.

7. The method according to claim 1, wherein the detecting step includes detecting the vibration signals in each case within at least one of a predetermined time window and a frequency window.

8. The method according to claim 7, including providing the at least one of the time window and frequency window in dependence on a crank angle of the piston-type engine.

9. The method according to claim 8, wherein the valve drives each comprise an electromagnetic valve drive arrangement having at least one electromagnet operatively connected for driving the respective cylinder valve, and the providing step includes predetermining at least one of the time window and frequency window for the respective cylinder valve in dependence on a current supply for the at least one electromagnet.

10. The method according to claim 9, and further comprising adjusting an absorption of energy into the at least one electromagnet in dependence on a magnitude of the detected vibration signals.

11. The method according to claim 1, wherein the actuating step includes changing the actuation times for the cylinder valve in dependence on the detected vibration signals.

12. The method according to claim 1, and further comprising additionally detecting existing basic engine noises and taking the additionally detected existing basic engine noises into consideration for determining a magnitude of the vibration signals.

13. The method according to claims 1, and further comprising additionally detecting knocking sounds that occur in the cylinder and taking the additionally detected knocking sounds into consideration during an evaluation of the vibration signals for actuating the cylinder valve.

* * * * *